US008186240B2

(12) United States Patent
Sakai et al.

(10) Patent No.: US 8,186,240 B2
(45) Date of Patent: May 29, 2012

(54) JOYSTICK TYPE SWITCH DEVICE

(75) Inventors: Naohiro Sakai, Saitama (JP); Yoshitaka Noguchi, Saitama (JP); Takashi Tsuzuki, Saitama (JP)

(73) Assignee: Toyo Denso Co., Ltd., Tokyo (JP)

( * ) Notice: Subject to any disclaimer, the term of this patent is extended or adjusted under 35 U.S.C. 154(b) by 643 days.

(21) Appl. No.: 12/298,982

(22) PCT Filed: Nov. 28, 2006

(86) PCT No.: PCT/JP2006/323687

§ 371 (c)(1),
(2), (4) Date: Oct. 29, 2008

(87) PCT Pub. No.: WO2007/141894

PCT Pub. Date: Dec. 13, 2007

(65) Prior Publication Data

US 2009/0084214 A1 Apr. 2, 2009

(30) Foreign Application Priority Data

May 30, 2006 (JP) ..... 2006-150486

(51) Int. Cl.
*G05G 9/047* (2006.01)
*G06F 3/033* (2006.01)
*H01H 21/00* (2006.01)

(52) U.S. Cl. ..... 74/471 XY; 345/161; 200/6 A

(58) Field of Classification Search ..... 74/471 XY; 345/161; 200/6 A

See application file for complete search history.

(56) References Cited

U.S. PATENT DOCUMENTS

| | | | | |
|---|---|---|---|---|
| 2,958,233 | A * | 11/1960 | Johnson | 74/471 R |
| 6,634,383 | B2 * | 10/2003 | Aarestad | 137/636.1 |
| 6,952,197 | B1 * | 10/2005 | Nakamura et al. | 345/157 |
| 2004/0060807 | A1 | 4/2004 | Nishimoto et al. | |

FOREIGN PATENT DOCUMENTS

| | | | |
|---|---|---|---|
| CN | 1652273 | A | 8/2005 |
| JP | 2002-091697 | A | 3/2002 |
| JP | 2004-087290 | A | 3/2004 |
| JP | 2005-122289 | A | 5/2005 |
| JP | 2005-122294 | A | 5/2005 |

* cited by examiner

*Primary Examiner* — Thomas R Hannon
*Assistant Examiner* — Phillip A Johnson
(74) *Attorney, Agent, or Firm* — Arent Fox LLP

(57) ABSTRACT

A joystick type switch device is provided that includes an operating shaft having an operating knob provided at one end, and a case supporting the operating shaft so that the operating shaft can move between a return position and a pushed-in position and tilt from a neutral position around a tilt center, it being possible to detect pushing of the operating shaft into the pushed-in position and tilting of the operating shaft from the neutral position into eight directions, wherein the operating shaft (16) has a magnet mounted at the other end, and a portion, facing the magnet, of a base plate (22) mounted on the case has at least three Hall elements (43A to 43D) fixed thereto at equal intervals around the axis of the operating shaft (16) in the neutral position. This enables excellent durability to be obtained and the number of components to be reduced.

3 Claims, 13 Drawing Sheets

JOYSTICK TYPE SWITCH DEVICE

TECHNICAL FIELD

The present invention relates to a joystick type switch device that includes an operating shaft having an operating knob provided at one end, and a case supporting the operating shaft so that the operating shaft can move along its axis between a return position and a pushed-in position and the operating shaft can tilt from a neutral position around a tilt center set on the axis, it being possible to detect pushing of the operating shaft, which is resiliently urged toward the neutral position and the return position, into the pushed-in position and tilting of the operating shaft from the neutral position into eight directions set at equal intervals around the axis.

BACKGROUND ART

A joystick type switch device is known from, for example, Patent Publication 1 in which a pushing operation of an operating shaft from a return position to a pushed-in position and a tilting operation of the operating shaft from a neutral position are each detected by a contact type switch.

Patent Publication 1: Japanese Patent Application Laid-open No. 2005-122294

DISCLOSURE OF THE INVENTION

Problems to be Solved by the Invention

However, in the arrangement disclosed by Patent Publication 1 above, not only does wear of a contact part occur, but also stress from the operating shaft acts on a base plate on which a fixed contact is provided, and there is therefore a problem with durability. Furthermore, since the pushing operation and the tilting operation of the operating shaft are detected separately by different switches, the number of switches required is large, and the number of components increases.

The present invention has been accomplished under such circumstances, and it is an object thereof to provide a joystick type switch device that has excellent durability and enables the number of components to be reduced.

Means for Solving the Problems

In order to attain the above object, in accordance with a first aspect of the present invention, there is provided a joystick type switch device comprising: an operating shaft having an operating knob provided at one end, and a case supporting the operating shaft so that the operating shaft can move along an axis thereof between a return position and a pushed-in position and the operating shaft can tilt from a neutral position around a tilt center set on the axis, it being possible to detect pushing of the operating shaft, which is resiliently urged toward the neutral position and the return position, into the pushed-in position and tilting of the operating shaft from the neutral position into eight directions set at equal intervals around the axis, characterized in that the operating shaft has a magnet mounted at the other end, and a portion, facing the magnet, of a base plate mounted on the case has at least three magnetic elements fixed thereto at equal intervals around the axis of the operating shaft in the neutral position.

In accordance with a second aspect of the present invention, in addition to the first aspect, click mechanisms are provided between the operating shaft and the case at four positions equally spaced around the axis of the operating shaft, the click mechanisms giving a click feel when the operating shaft is tilted from the neutral position beyond a predetermined angle.

Effects of the Invention

In accordance with the first aspect of the present invention, both pushing and tilting of the operating shaft can be detected by a change in the output of each of at least three magnetic elements that depends on the relative position between the magnet mounted on the operating shaft and the magnetic elements fixed to the base plate mounted on the case. There is therefore no wear in the detection section, and no stress acts on the base plate from the operating shaft; is it thus possible to not only obtain excellent durability, but also to reduce the number of components and the cost compared with a conventional arrangement in which pushing and tilting of an operating shaft are separately detected by different switches.

Furthermore, in accordance with the second aspect of the present invention, since a click feel can be given when the operating shaft is tilted beyond a predetermined angle, in a case in which the speed of movement of a cursor is set so as to change in response to the tilt angle of the operating shaft when the cursor on a screen is moved in the tilt direction, the click feel is obtained when the speed of movement of the cursor changes, thus making operation of the cursor on the screen agreeable.

EXPLANATION OF REFERENCE NUMERALS AND SYMBOLS

15 Operating Knob
16 Operating Shaft

18 Case
22 Base Plate
41 Magnet
43A to 43G Hall Element as Magnetic Element
45 Click Mechanism
C Tilt Center

BEST MODE FOR CARRYING OUT THE INVENTION

Modes for carrying out the present invention are explained below by reference to Embodiments of the present invention shown in the attached drawings.

Embodiment 1

FIG. 1 to FIG. 12 show a first embodiment of the present invention.

Figure 1:
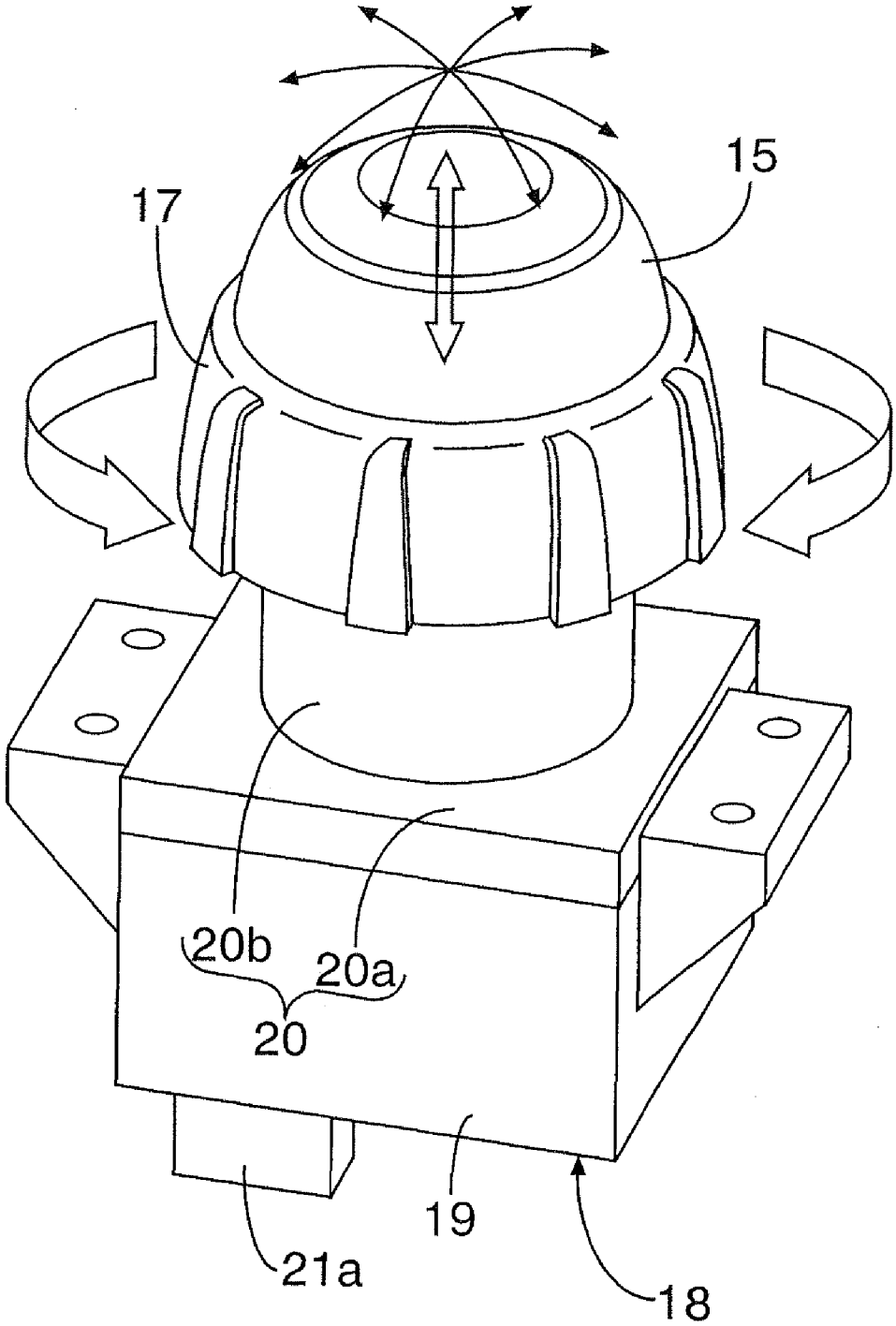
FIG. 1 is an overall perspective view of a joystick type switch device of a first embodiment (first embodiment).
Figure 2:
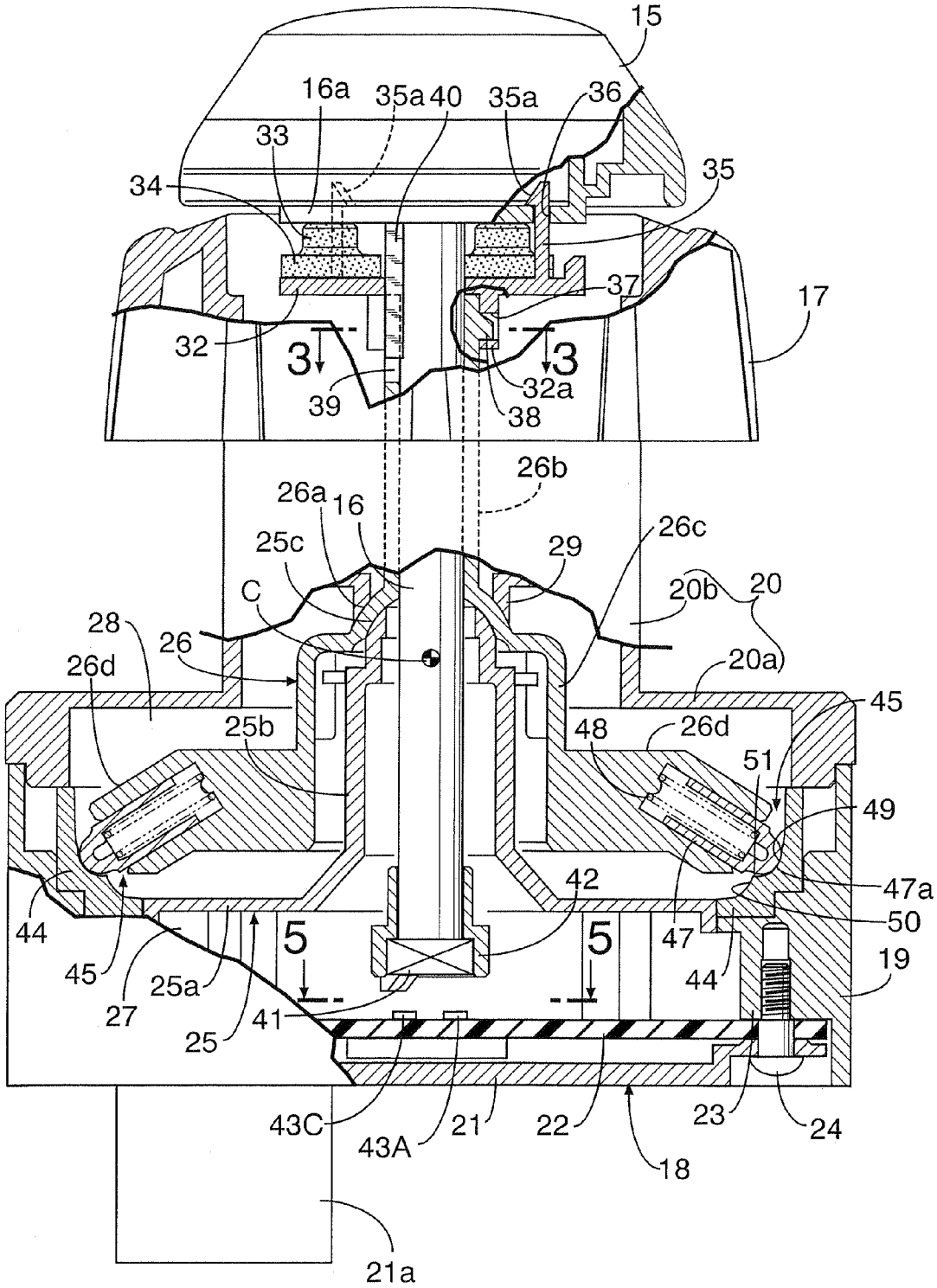
FIG. 2 is a vertical sectional side view of the joystick type switch device (first embodiment).

Referring firstly to FIG. 1 and FIG. 2, this joystick type switch device is used, for example, for operating a cursor on a screen of a car navigation system, and includes an operating shaft 16 having an operating knob 15 provided at one end and a case 18 supporting the operating shaft 16.

Although the joystick type switch device of this embodiment has a dial switch knob 17 disposed at a position adjacent to the operating knob 15 so that it can be rotated around the axis of the operating shaft 16 and a rotational position detection section (not illustrated) for detecting the rotational operation position of the dial switch knob 17, since this is not relevant to the gist of the present invention, detailed structures of the dial switch knob 17 and the rotational position detection section are not described in the following explanation.

The case 18 is formed from a tube-shaped case main body 19 having a rectangular cross-section, a first cover member 20 closing an opening at one end of the case main body 19, and a second cover member 21 closing an opening at the other end of the case main body 19, the first cover member 20 integrally having a rectangular dish-shaped cover portion 20*a* for closing the opening at the one end of the case main body 19 and a cylindrical portion 20*b* coaxially surrounding the operating shaft 16 and having its base portion connected to the cover portion 20*a* at a right angle, and the extremity of the cylindrical portion 20*b* projecting into the interior of the dial switch knob 17. Furthermore, the second cover member 21 is formed in a rectangular shape so that it fits into the opening at the other of the case main body 19 and is secured, together with a flat plate-shaped base plate 22 housed within the case main body 19, to a supporting step 23 provided on the case main body 19, by means of a plurality of screw members 24 with the base plate 22 interposed between the second cover member 21 and the supporting step 23.

The operating shaft 16 has one end projecting from the cylindrical portion 20*b* of the first cover member 20 and the other end running through the cylindrical portion 20*b* and projecting into the interior of the case 18, and a tilt support member 25 is fixed to the case 18, the tilt support member 25 supporting the operating shaft 16 so that the operating shaft 16 can tilt from a neutral position in which the axis of the operating shaft 16 is perpendicular to the base plate 22. This tilt support member 25 integrally has a dividing wall portion 25*a* and a cylindrical tubular supporting portion 25*b*, the dividing wall portion 25*a* defining within the case 18 a first operation chamber 27, in which the base plate 22 is disposed, and a second operation chamber 28 on the operating knob 15 side, the tubular supporting portion 25*b* extending from a central area of the dividing wall portion 25*a* toward the second operation chamber 28 side and surrounding the operating shaft 16. The tubular supporting portion 25*b* has a receiving seat 25*c* formed at its extremity, the receiving seat 25*c* following the surface of an imaginary sphere having as its center a tilt center C set on the axis of the operating shaft 16.

The operating shaft 16 is equipped with an operating shaft retaining member 26 so that relative movement in a confined range along the axis of the operating shaft 16 is possible but relative rotation around the axis of the operating shaft 16 is prevented, and the operating shaft retaining member 26 includes a tilt support portion 26*a*, which is formed so as to follow the surface of the imaginary sphere of the receiving seat 25*c* and is in sliding contact with the receiving seat 25*c* from the operating knob 15 side, a cylindrical portion 26*b*, which is connected to the tilt support portion 26*a* via a base part and coaxially surrounds the one end of the operating shaft 16, a cylindrical skirt portion 26*c*, which surrounds the tubular supporting portion 25*b* of the tilt support member 25 and is connected to the tilt support portion 26*a*, and four support arm portions 26*d* extending radially from four positions equally spaced in the peripheral direction of the skirt portion 26*c*. Moreover, the cylindrical portion 20*b* of the first cover member 20 of the case 18 is provided with a retaining part 29 for holding the tilt support portion 26*a* between itself and the receiving seat 25*c*, and the operating shaft 16 and the operating shaft retaining member 26 are supported on the case 18 so that they can tilt with the tilt center C as the center.

The one end of the operating shaft 16, which projects from the extremity of the cylindrical portion 26*b* of the operating shaft retaining member 26, is integrally provided with a disk-shaped knob mounting portion 16*a* extending radially outward from the operating shaft 16, and the operating knob 15 is mounted on the knob mounting portion 16*a*. Furthermore, disposed inward of the knob mounting portion 16*a* is a knob retaining member 32 having the operating shaft 16 running therethrough, and provided on the knob mounting portion 16*a* and the knob retaining member 32 at a plurality of positions equally spaced in the peripheral direction of the operating shaft 16 are rubbers 33 and 34 respectively that abut against each other. Furthermore, a plurality of connecting legs 35 having their base parts provided integrally with the knob retaining member 32 and extending in the axial direction of the operating shaft 16 are movably inserted into latching holes 36 provided in the knob mounting portion 16*a*, and an engagement latch 35*a* that can engage with the knob mounting portion 16*a* from the operating knob 15 side is provided at the extremity of each of the connecting legs 35.

Figure 3:
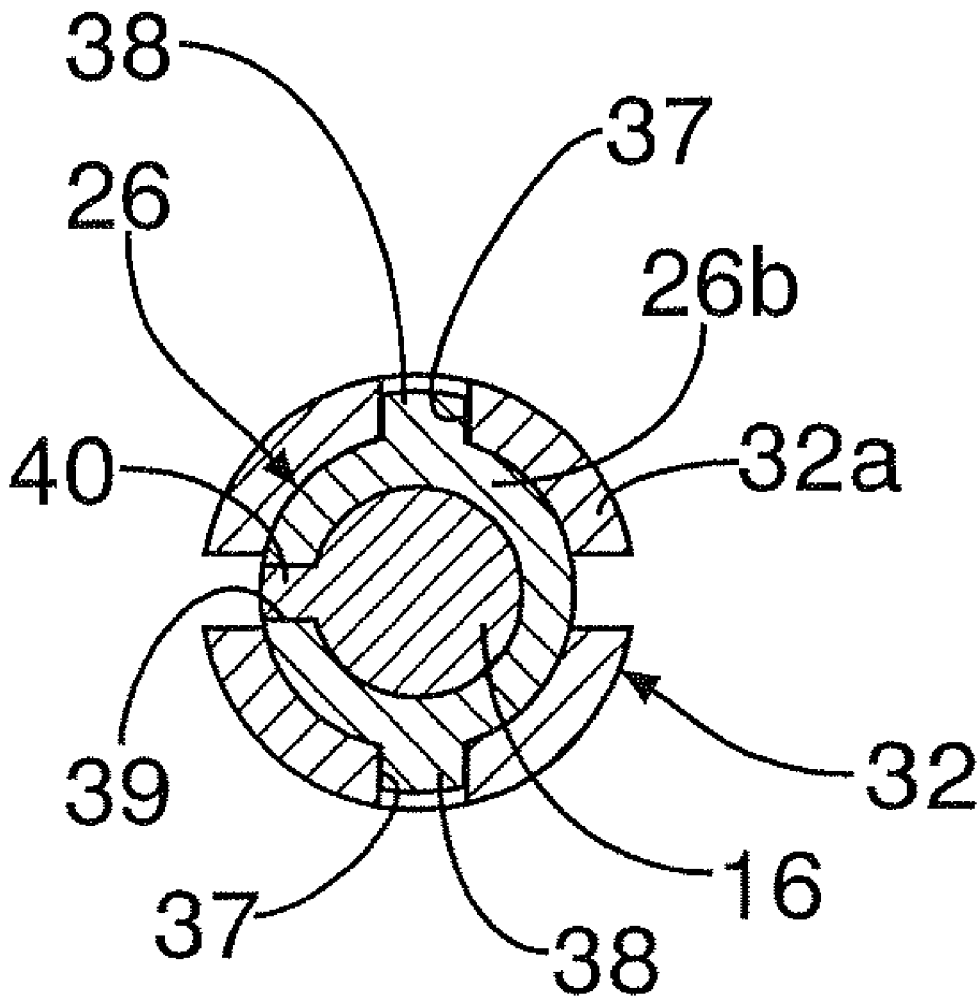
FIG. 3 is a sectional view along line 3-3 in FIG. 2 (first embodiment).
Figure 4:
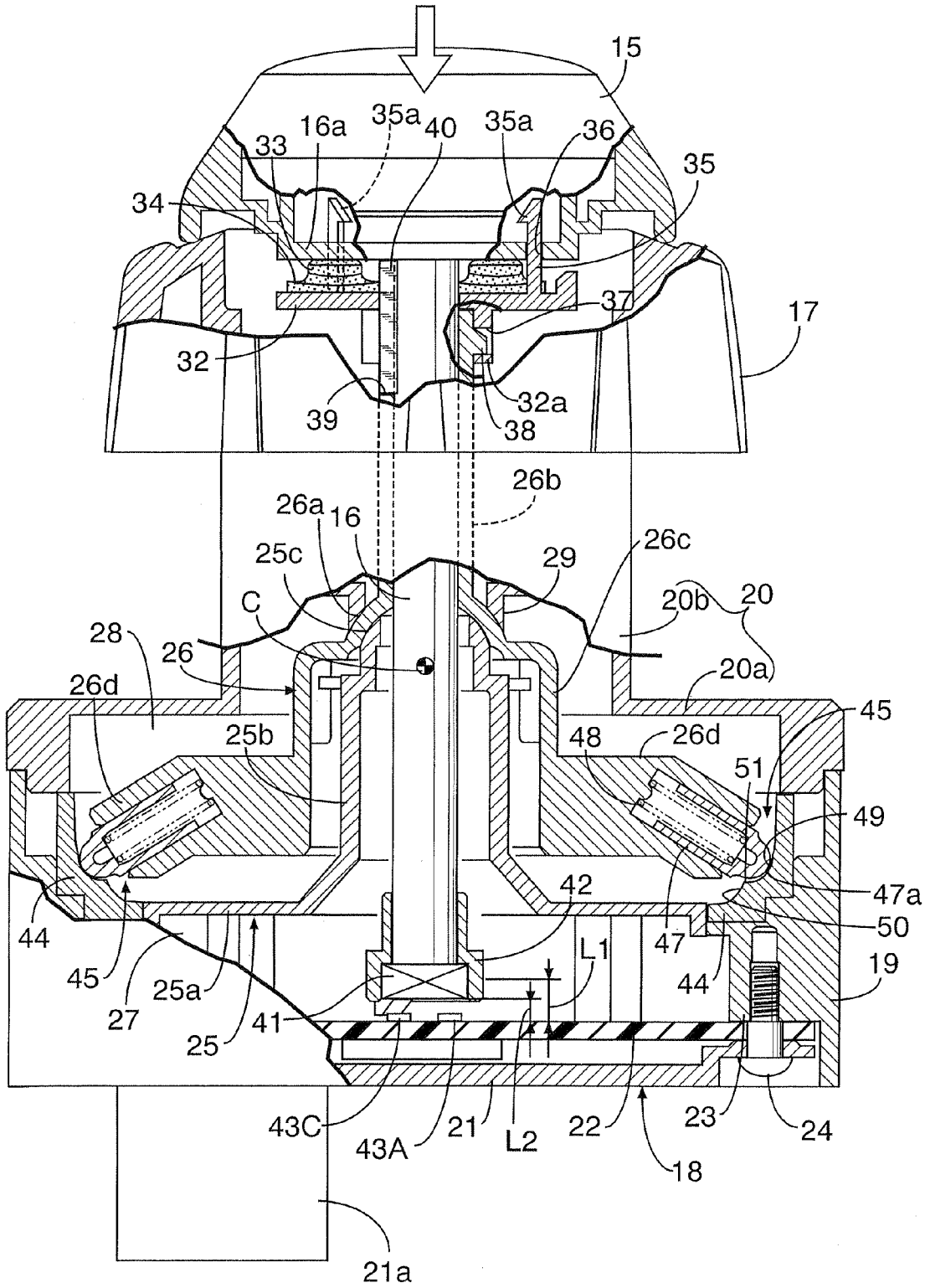
FIG. 4 is a vertical sectional side view corresponding to FIG. 2 when an operating shaft in a neutral position is pushed (first embodiment).

Moreover, the knob retaining member 32 is provided integrally with a connecting tubular portion 32*a*, which coaxially surrounds the extremity of the cylindrical portion 26*b* of the operating shaft retaining member 26, and as shown in FIG. 3, resilient engagement of engagement latches 38 and 38 projectingly provided on the outer periphery of the extremity of the cylindrical portion 26*b* with latching holes 37 and 37 provided at a plurality of, for example, two, positions of the connecting tubular portion 32*a* allows the knob retaining member 32 to be connected to the cylindrical portion 26*b* of the operating shaft retaining member 26.

Moreover, the cylindrical portion 26*b* of the operating shaft retaining member 26 is provided with an engagement slit 39 that opens at the extremity of the cylindrical portion 26*b* and extends axially, and a key 40 for engaging with the engagement slit 39 is provided on the outer periphery of the one end of the operating shaft 16. The operating shaft 16, which has the operating knob 15 provided at the one end, is therefore retained by the operating shaft retaining member 26 so that it can move between a return position (position shown in FIG. 2), in which the plurality of engagement latches 35*a* of the knob retaining member 32 mounted on the operating shaft 16 engage with the knob mounting portion 16*a* from the operating knob 15 side, and a pushed-in position (position shown in FIG. 4), in which the key 40 abuts against and engages with an inner end of the engagement slit 39, and the operating shaft 16 is urged toward the return position by virtue of the resilient force exhibited by the rubbers 33 and 34, a plurality of which are provided on the knob mounting portion 16*a* and the knob retaining member 32 so that they abut against each other.

Figure 5:
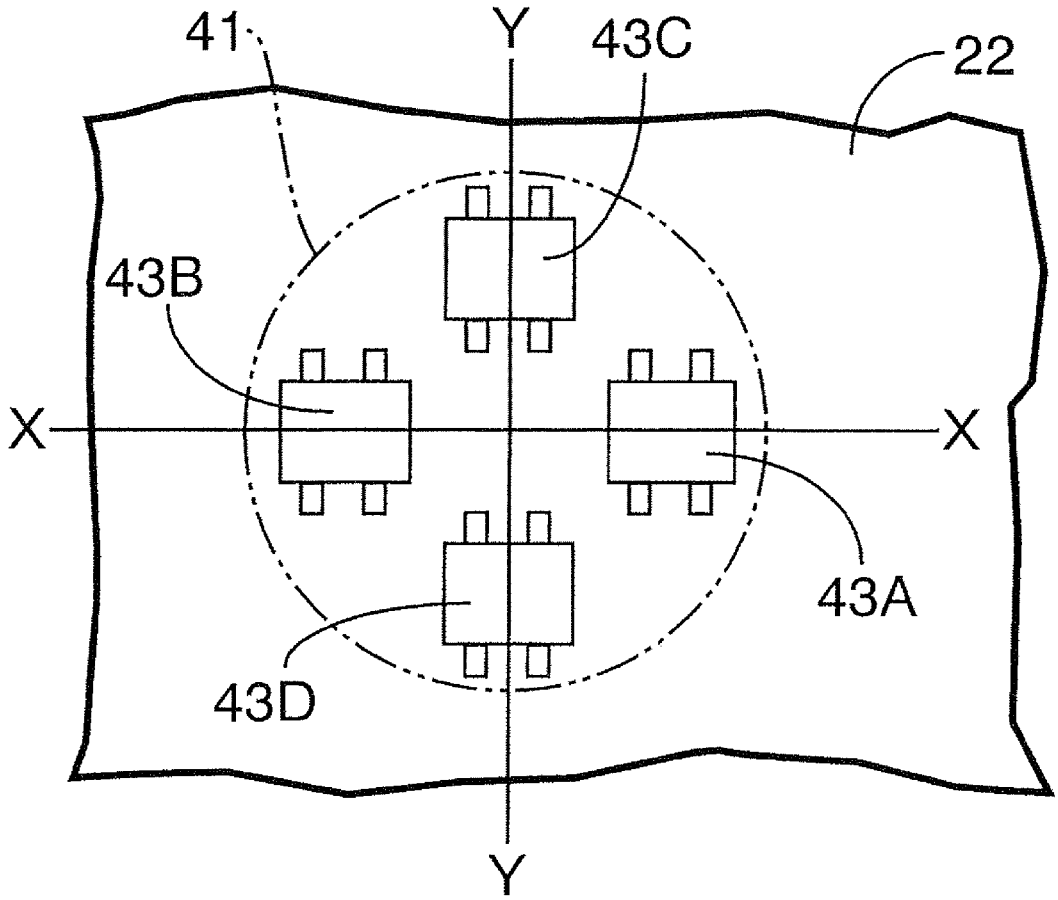
FIG. 5 is a view from arrowed line 5-5 in FIG. 2 (first embodiment).

Referring in addition to FIG. 5, a magnet 41 is mounted on the other end of the operating shaft 16. This magnet 41 is retained by a magnet retaining member 42, and the magnet retaining member 42 is fitted on and fixed to the other end of the operating shaft 16. At least three magnetic elements, and in this first embodiment four Hall elements 43A to 43D, which are magnetic elements, are fixed to a portion of the base plate 22 facing the magnet 41 at equal intervals around the axis of the operating shaft 16 in the neutral position, a pair of Hall elements 43A and 43B among the Hall elements 43A to 43D are disposed side by side in the direction of an X-X axis passing through an extension of the axis of the operating shaft 16 in the neutral position, and the remaining pair of Hall elements 43C and 43D are fixedly disposed on the base plate 22 side by side in the direction of a Y-Y axis that is orthogonal to the direction of the X-X axis and passes through an extension of the axis of the operating shaft 16 in the neutral position.

Moreover, the base plate 22 is fixed to the case 18 so that the magnet 41 is not in contact with the Hall elements 43A to 43D regardless of whether the operating shaft 16 is in the return position or the pushed-in position; a gap between the magnet 41 and the base plate 22 when the operating shaft 16 in the neutral position is in the return position is defined as L1, and a gap L2 between the base plate 22 and the magnet 41 at the other end of the operating shaft 16 when it has been pushed from the return position to the pushed-in position is smaller than the gap L1.

Provided on the base plate 22 are the four Hall elements 43A to 43D and a circuit (not illustrated) for processing outputs from the Hall elements 43A to 43D, and provided integrally with the second cover member 21 of the case 18 is a coupler portion 21*a* for connecting an external lead to the circuit.

Figure 6:
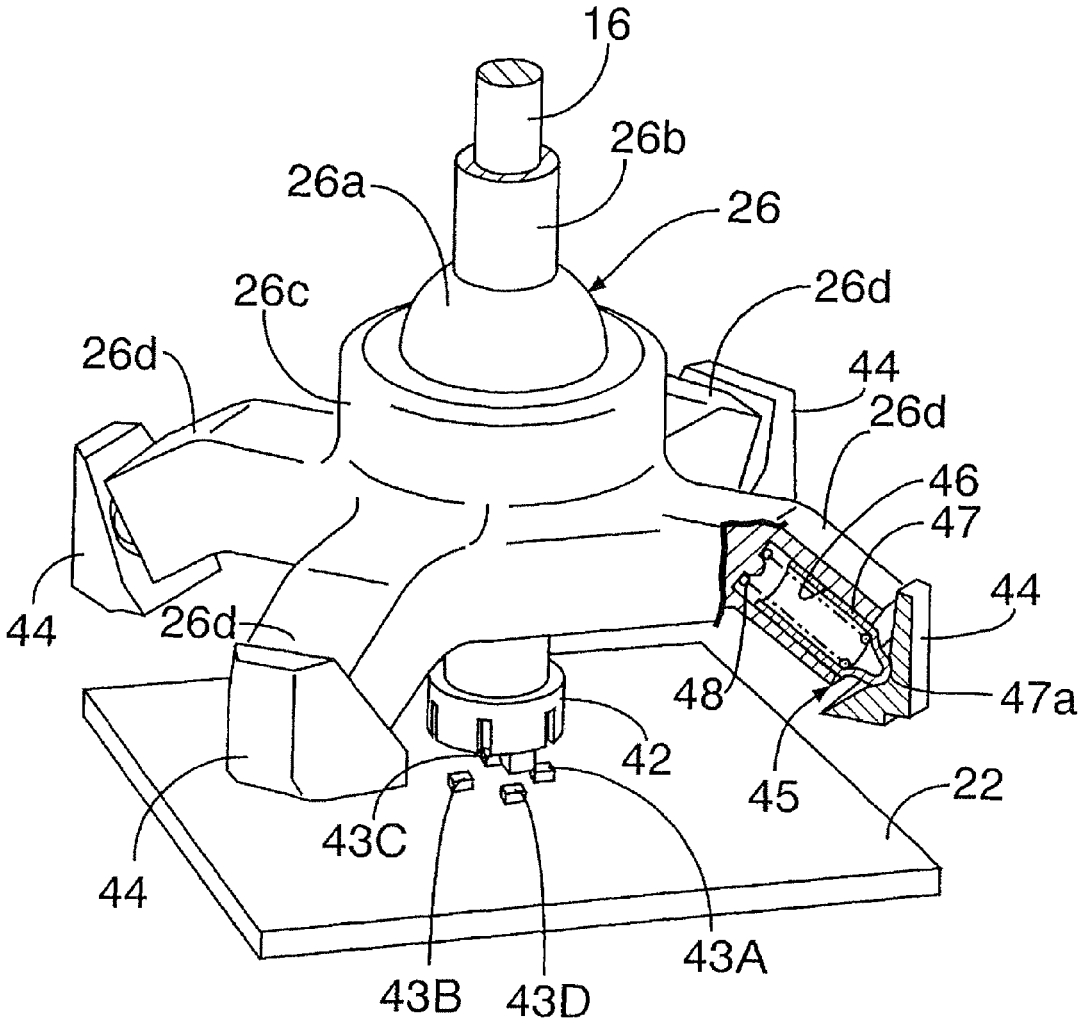
FIG. 6 is a perspective view of an essential part of the operating shaft and a base plate (first embodiment).
Figure 7:
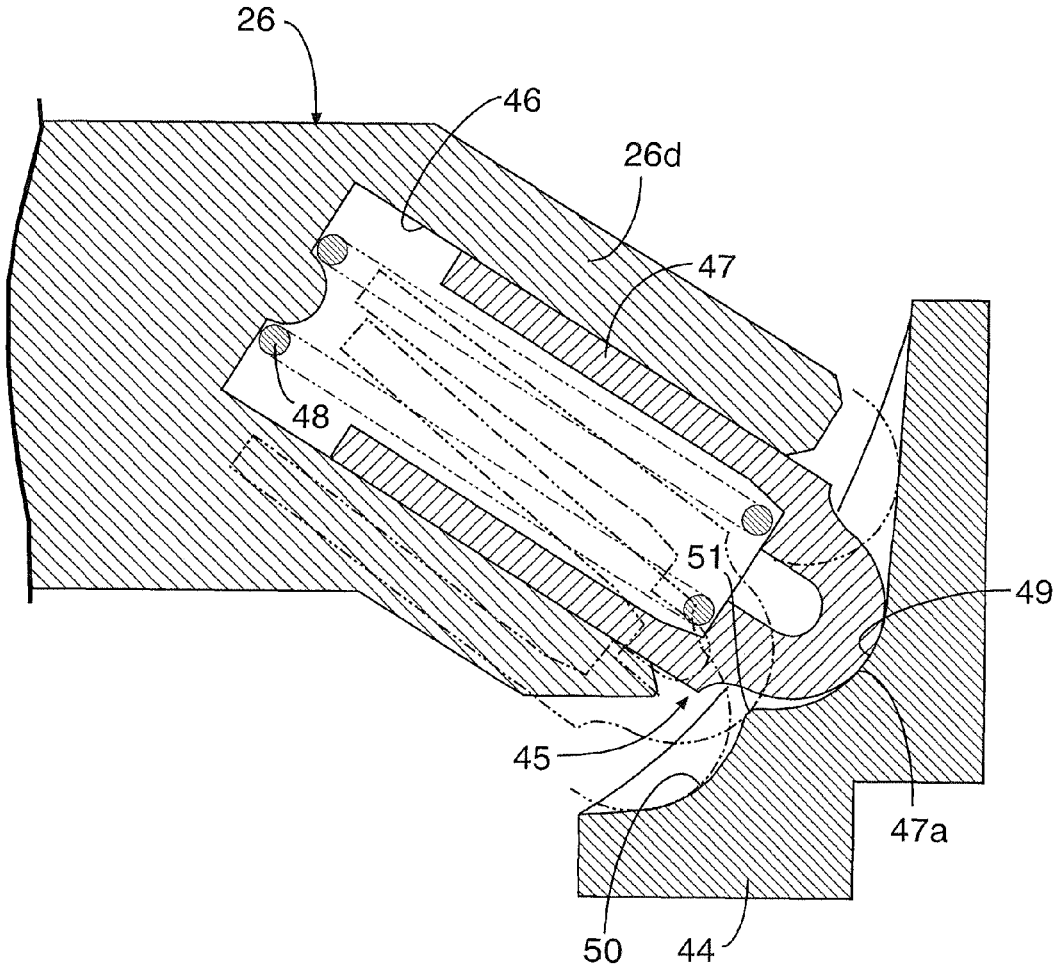
FIG. 7 is an enlarged vertical sectional view of a click mechanism (first embodiment).

In FIG. 6 and FIG. 7, base parts of the support arm portions 26*d* of the operating shaft retaining member 26 are provided so as to be connected to the skirt portion 26*c* of the operating shaft retaining member 26 at positions displaced by 45 degrees around the axis of the operating shaft 16 relative to the X-X axis direction and the Y-Y axis direction, and click mechanisms 45 are provided between the extremities of the support arm portions 26*d* and receiving members 44 fixed to the case 18.

The click mechanism 45 is formed from a bottomed support hole 46 opening on the receiving member 44 side and provided on an extremity part of the support arm portion 26*d*, a bottomed cylindrical sliding member 47 having at a closed end a spherical abutment portion 47*a* that comes into sliding contact with the receiving member 44 and being slidably fitted into the support hole 46, and a coil-shaped click spring 48 provided in a compressed state between a closed end of the support hole 46 and the sliding member 47.

The spring force of the click springs 48 of the click mechanisms 45 provided between the four support arm portions 26*d* of the operating shaft retaining member 26 and the receiving members 44 fixed to the case 18 acts on the operating shaft 16 from the four positions equally spaced in the peripheral direction of the operating shaft 16 toward the axis of the operating shaft 16, and the operating shaft 16 is urged toward the neutral position by means of the spring force of the click springs 48.

Figure 8:
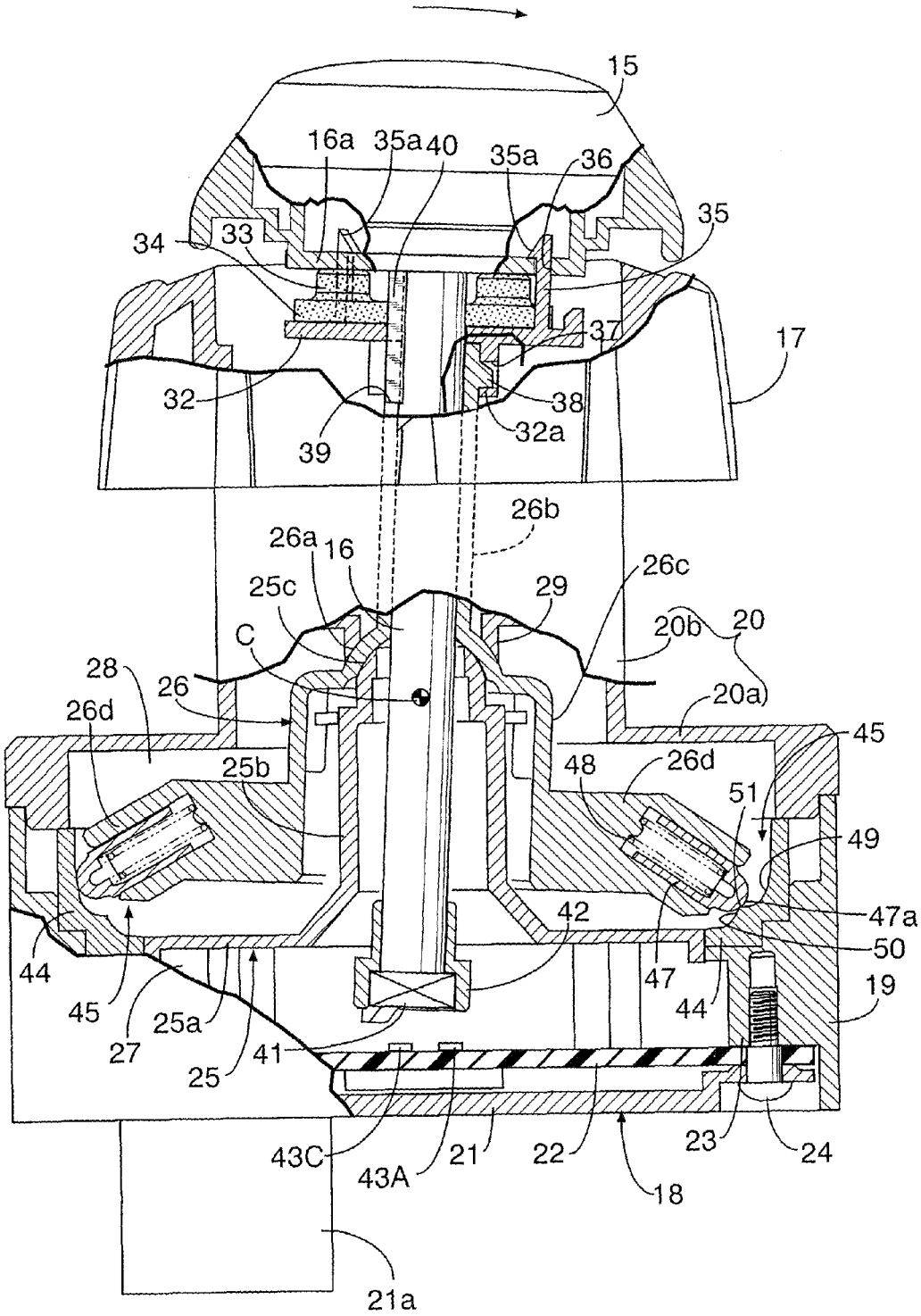
FIG. 8 is a vertical sectional side view, corresponding to FIG. 2, in a state in which the operating shaft is tilted from the neutral position (first embodiment).
Figure 9:
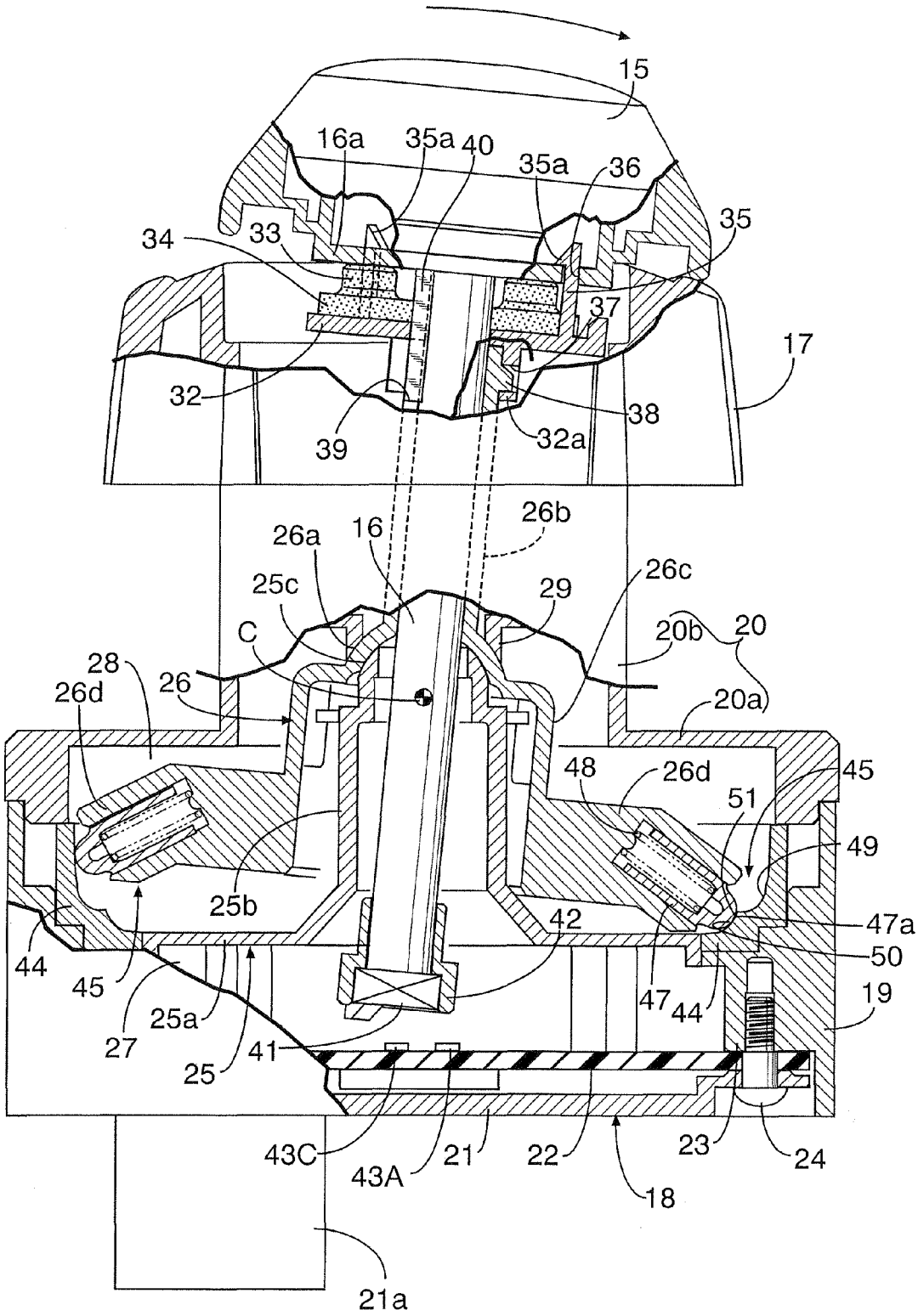
FIG. 9 is a vertical sectional side view, corresponding to FIG. 8, when the operating shaft is further tilted from the state shown in FIG. 8 (first embodiment).

The receiving member 44 is provided with a first guide recess 49 that comes into sliding contact with the spherical abutment portion 47*a* of the sliding member 47 when as shown in FIG. 8 the operating shaft 16 is tilted within a predetermined angle range from the neutral position, a second guide recess 50 that comes into sliding contact with the spherical abutment portion 47*a* of the sliding member 47 when as shown in FIG. 9 the operating shaft 16 is tilted beyond the predetermined angle range, and a ridge part 51 disposed between the first and second guide recesses 49 and 50; when the operating shaft 16 is tilted from the state of FIG. 8 to the state of FIG. 9, it is necessary to apply a force that will compress the click spring 48 so that the spherical abutment portion 47*a* rides over the ridge part 51, and the click mechanism 45 gives click feel to an operator of the operating knob 15 when the operating shaft 16 tilts from the neutral position beyond a predetermined angle (e.g. 30 degrees).

Figure 10:
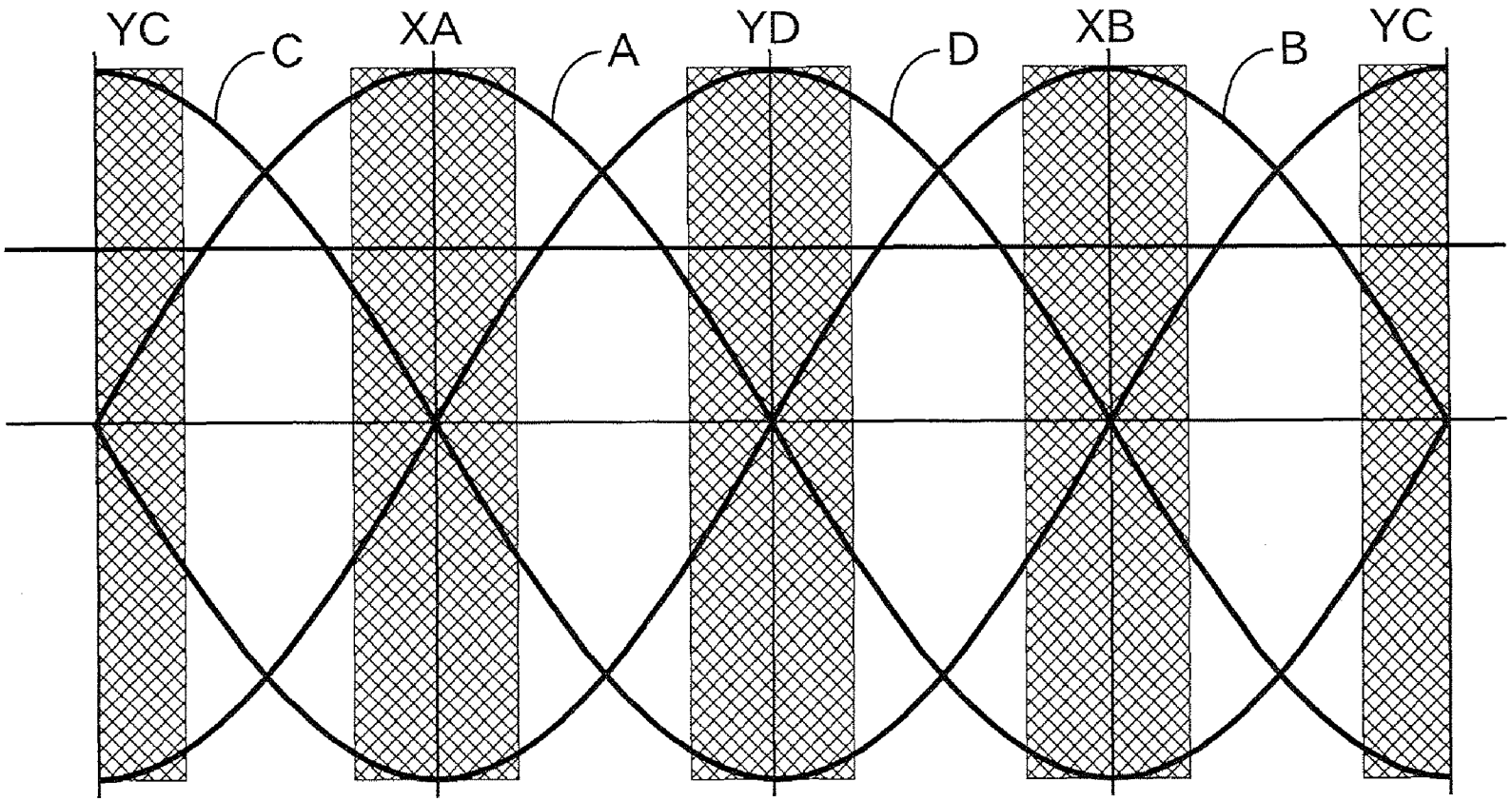
FIG. 10 is a view showing change in output from Hall elements according to a tilting operation of the operating shaft (first embodiment).

The operating shaft 16 can tilt in any direction from the neutral position, and outputs A to D from the Hall elements 43A to 43D change as shown in FIG. 10, where the XA direction is when the operating shaft 16 is tilted toward the Hall element 43A along the X-X axis direction, the XB direction is when the operating shaft 16 is tilted toward the Hall element 43B along the X-X axis direction, the YC direction is when the operating shaft 16 is tilted toward the Hall element 43C along the Y-Y axis direction, and the YD direction is when the operating shaft 16 is tilted toward the Hall element 43D along the Y-Y axis direction. Therefore, depending on the combination of outputs from the Hall elements 43A to 43D, it is possible to detect tilting of the operating shaft 16 from the neutral position to eight directions set at equal intervals around the axis of the operating shaft 16.

Figure 11:
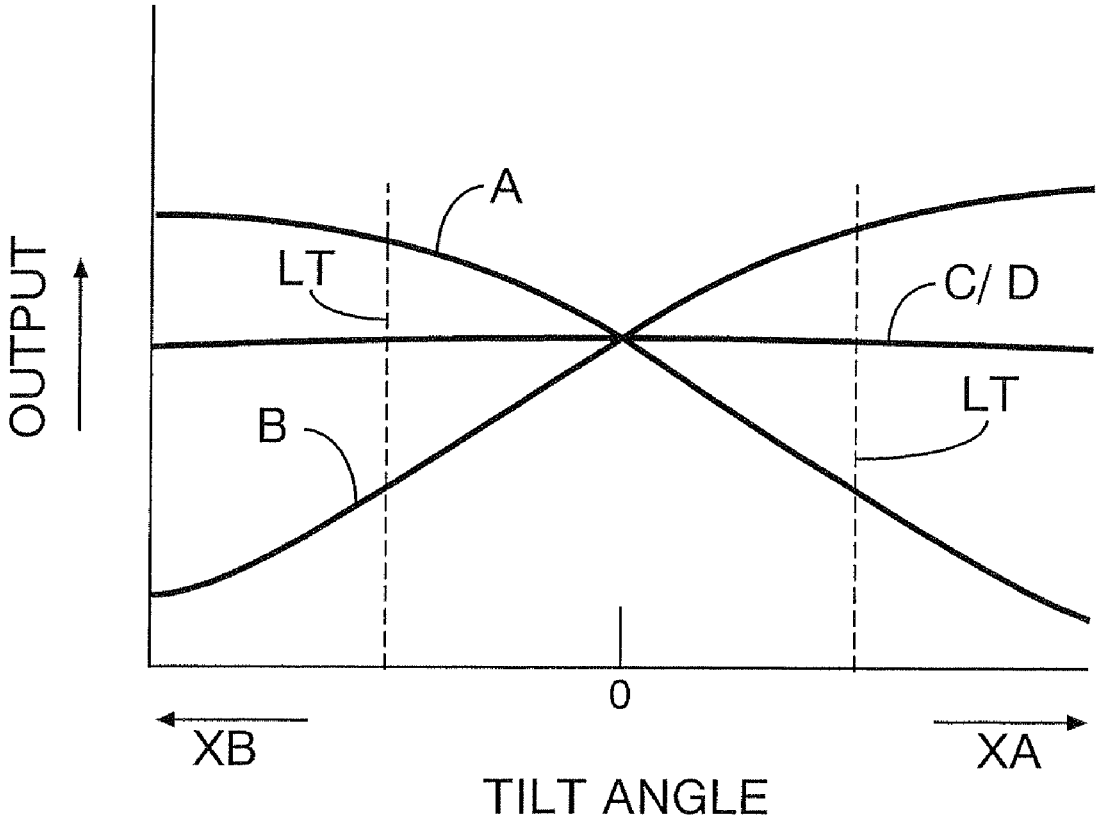
FIG. 11 is a view showing change in output from the joystick type switch device when the operating shaft is tilted in the X axis direction (first embodiment).

In this first embodiment, among the four Hall elements 43A to 43D, two each of which are disposed in the X-X axis direction and the Y-Y axis direction respectively, outputs of the Hall elements 43C and 43D, which are disposed in either one of the X-X axis direction and the Y-Y axis direction, for example, in the Y-Y axis direction, are outputted from the joystick type switch device as one differentially calculated combined output, and in this case the outputs A and B of the Hall elements 43A and 43B and the combined output C/D of the Hall elements 43C and 43D when the operating shaft 16 is tilted in the X-X axis direction change according to the tilt angle of the operating shaft 16 as shown in FIG. 11; when it is tilted toward the Hall element 43A side the output B of the Hall element 43B increases and the output A of the Hall element 43A decreases, and when it is tilted toward the Hall element 43B side the output A of the Hall element 43A increases and the output B of the Hall element 43B decreases. In this process, since there is hardly any change in the position of the magnet 41 relative to the Hall elements 43C and 43D, there is hardly any change in the combined output C/D.

Figure 12:
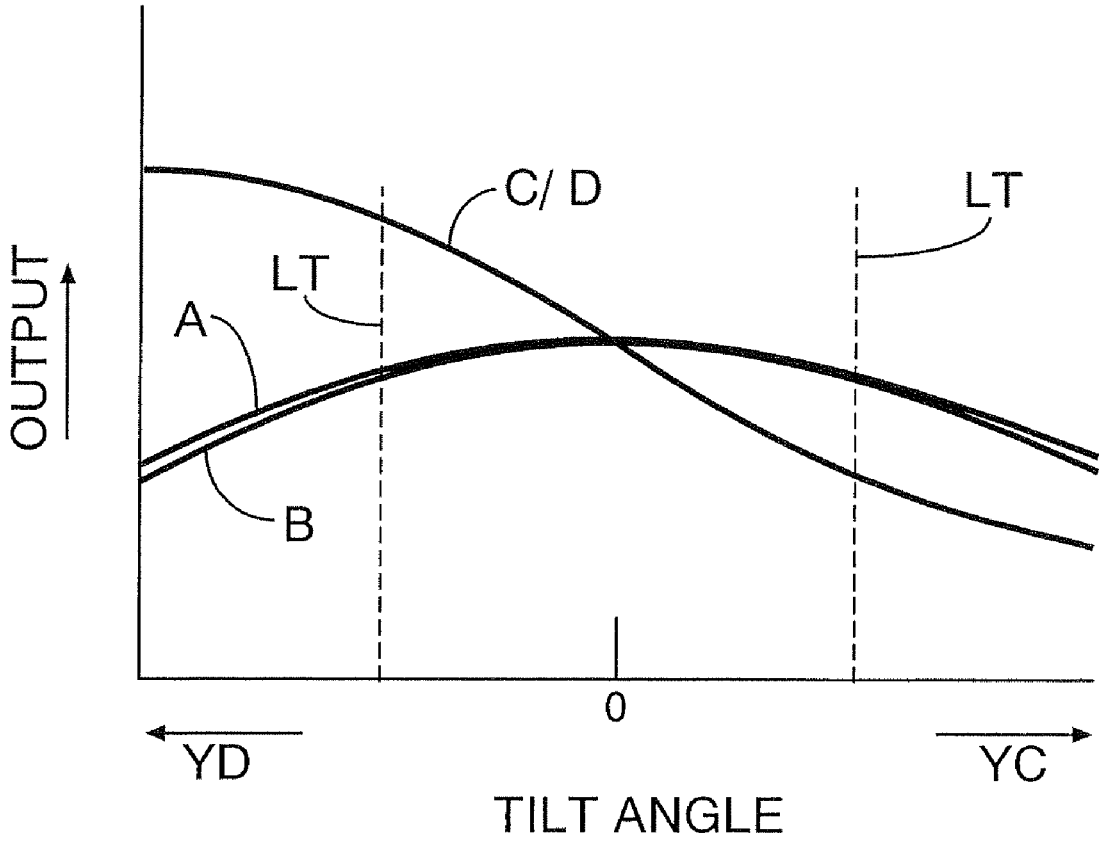
FIG. 12 is a view showing change in output from the joystick type switch device when the operating shaft is tilted in the Y axis direction (first embodiment).

Furthermore, the outputs A and B of the Hall elements 43A and 43B and the combined output C/D of the Hall elements 43C and 43D when the operating shaft 16 is tilted in the Y-Y axis direction change according to the tilt angle of the operating shaft 16 as shown in FIG. 12; when it is tilted toward the Hall element 43D side the combined output C/D increases, and when it is tilted toward the Hall element 43C side the combined output C/D decreases. In this process, since there is hardly any change in the position of the magnet 41 relative to the Hall elements 43A and 43B, there is hardly any change in the outputs A and B of the Hall elements 43A and 43B.

Although the four Hall elements 43A to 43D are used in this way, three outputs are obtained from the joystick type switch device, thereby simplifying a detection signal processing circuit and reducing the number of components.

In accordance with the above-mentioned click mechanisms 45, a click feel can be given when the operating shaft 16 is tilted from the neutral position beyond a predetermined angle; lines LT in FIG. 11 and FIG. 12 are set with the timing of the click feel being given, and the speed of movement of a cursor on a screen is set so that it becomes fast when the outputs A and B of the Hall elements 43A and 43B and the combined output C/D of the Hall elements 43C and 43D change beyond the lines LT, that is, when the operating shaft 16 is tilted by a large amount.

The operation of the first embodiment is now explained; the operating shaft 16 is supported by the case 18 and has the operating knob 15 mounted on one end and the magnet 41 mounted on the other end, and at least three (four in this first embodiment) Hall elements 43A to 43D are fixed to the portion, facing the magnet 41, of the base plate 22 mounted on the case 18, the Hall elements 43A to 43D being equally spaced around the axis of the operating shaft 16 in the neutral position.

As a result, since the output of each of the Hall elements 43A to 43D changes according to the position relative to the magnet 41 mounted on the operating shaft 16, both pushing and tilting of the operating shaft 16 can be detected from the change, the detection section does not become worn, no stress acts on the base plate 22 from the operating shaft 16, and excellent durability can be obtained. Moreover, compared with a conventional arrangement in which pushing and tilting of the operating shaft 16 are detected separately by different switches, the number of components can be reduced, and the cost can be reduced.

Furthermore, since the click mechanisms 45 for giving a click feel when the operating shaft 16 tilts from the neutral position beyond a predetermined angle are provided between the operating shaft 16 and the case 18 at four positions equally spaced around the axis of the operating shaft 16, it is possible to give a click feel when the operating shaft 16 is tilted beyond a predetermined angle, and in a case in which the speed of movement of the cursor is set so as to change according to the tilt angle when the cursor on the screen is moved in the direction in which the operating shaft 16 tilts, a click feel can be obtained when the speed of movement of the cursor changes, thus making the operation of the cursor on the screen agreeable.

Embodiment 2

Figure 13:
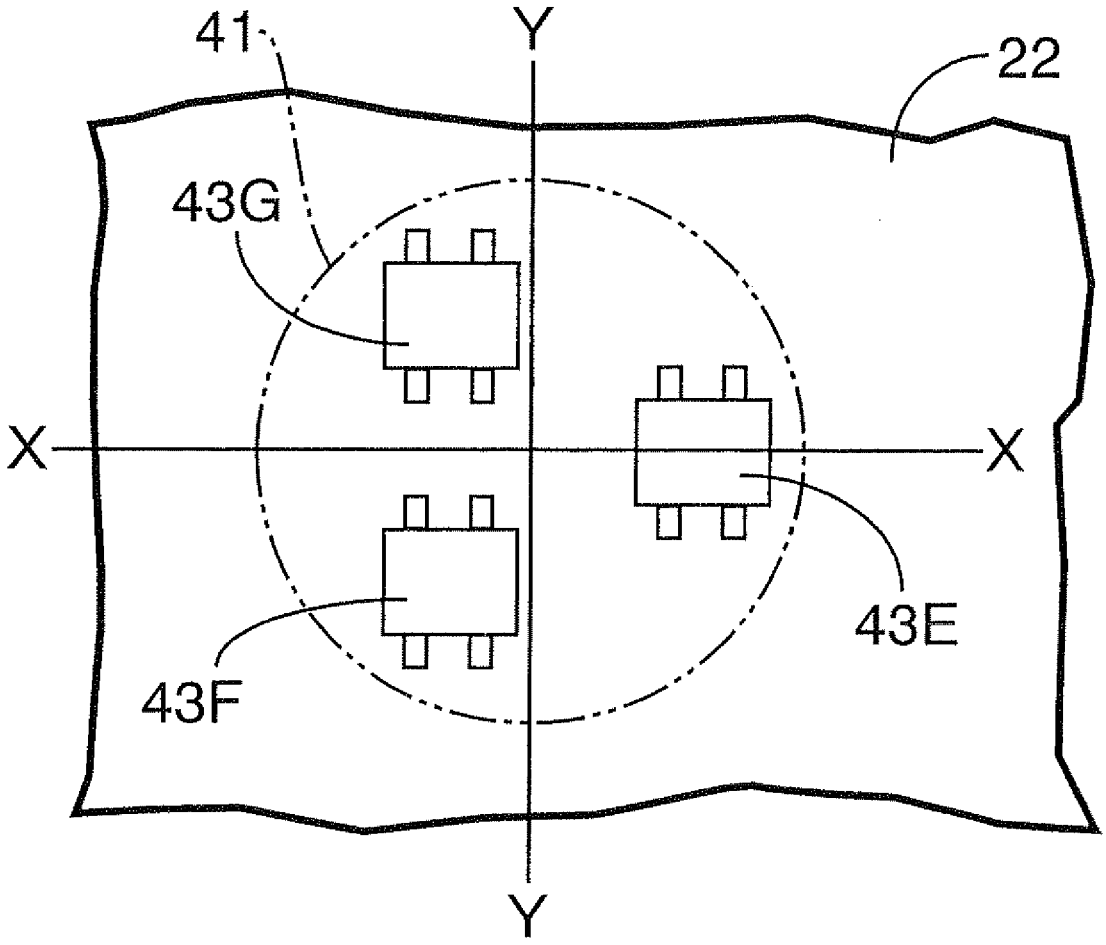
FIG. 13 is a view, corresponding to FIG. 5, of a first embodiment (second embodiment).

As a second embodiment of the present invention, as shown in FIG. 13, three Hall elements 43E, 43F, and 43G may be fixed to a portion of a base plate 22 facing a magnet 41, the Hall elements 43E, 43F, and 43G being equally spaced around the axis of an operating shaft 16 in a neutral position (ref. the first embodiment), and in accordance with this second embodiment, the same effects as those of the first embodiment can be obtained.

Embodiments of the present invention are explained above, but the present invention is not limited by the above-mentioned embodiments and can be modified in a variety of ways as long as the modifications do not depart from the spirit and scope of the present invention described in Claims.

The invention claimed is:

1. A joystick type switch device comprising:

an operating shaft having an operating knob provided at one end, and a case supporting the operating shaft wherein the operating shaft is movable along an axis thereof between a return position and a pushed-in position and the operating shaft is tiltable from a neutral position around a tilt center (C) set on the axis, the operating shaft being resiliently urged toward the neutral position and the return position, wherein the operating shaft has a magnet mounted at the other end, and a portion, facing the magnet, of a base plate mounted on the case has at least three magnetic elements fixed thereto at equal intervals around the axis of the operating shaft in the neutral position, wherein a change in output of each of the at least three magnetic elements indicates a pushing of the operating shaft into the pushed-in position and tilting of the operating shaft from the neutral position into eight directions set at equal intervals around the axis, wherein click mechanisms are provided between the operating shaft and the case at four positions equally spaced around the axis of the operating shaft, the click mechanisms giving a click feel when the operating shaft is tilted from the neutral position beyond a predetermined angle, and wherein the click mechanisms are provided, respectively, between the case and support arm portions of an operating shaft retaining member which retains the operating shaft.

2. The joystick type switch device according to claim 1, wherein as said magnetic elements, four magnetic elements are provided and outputs of two of the four magnetic elements are outputted as one differentially calculated combined output.

3. The joystick type switch device according to claim 1, wherein tilting of the operating shaft is configured to be associated with movement of a cursor on a screen, the click mechanisms give the click feel when a movement speed of the cursor on the screen changes.

* * * * *